US006017007A

United States Patent [19]

Muzzi

[11] Patent Number: 6,017,007

[45] Date of Patent: Jan. 25, 2000

[54] PORTABLE COLLAPSIBLE TODDLER SWING STAND

[76] Inventor: Roland J. Muzzi, 230 NW. 53 St., Fort Lauderdale, Fla. 33309

[21] Appl. No.: 09/078,704

[22] Filed: May 14, 1998

[51] Int. Cl.[7] ..... F16M 11/20

[52] U.S. Cl. ..... 248/163.2; 248/165; 248/166; 472/118

[58] Field of Search ..... 248/163.2, 165, 248/163, 167, 170, 440, 532, 530, 156, 1

[56] References Cited

U.S. PATENT DOCUMENTS

| | | | |
|---|---|---|---|
| 127,134 | 5/1872 | Wygant . | |
| 764,472 | 7/1904 | Kessler | 248/167 |
| 832,163 | 10/1906 | Ruger, Jr. | 248/163.2 |
| 1,556,624 | 10/1925 | Pavenick | 248/163.2 |
| 2,408,247 | 9/1946 | Wekeman | 248/165 |
| 2,634,450 | 4/1953 | Britton | 248/165 |
| 2,924,414 | 2/1960 | Tesdal | 248/165 |
| 3,990,667 | 11/1976 | Tomalinas | 248/370 |
| 5,217,194 | 6/1993 | Brownell | 248/156 |
| 5,564,987 | 10/1996 | Ayrolles | 472/118 |
| 5,628,689 | 5/1997 | Saint | 472/118 |
| 5,749,386 | 5/1998 | Samuel, Jr. | 248/530 |

*Primary Examiner*—Derek J. Berger
*Assistant Examiner*—Walter Landry
*Attorney, Agent, or Firm*—Alvin S. Blum

[57] ABSTRACT

A stand for a toddler's swing supported by an overhead horizontal bar has a compact mode for transport and storage and an operational mode. In the operational mode a horizontal bar has a pair of legs at each end of the bar forming triangles with apices at the bar. The legs of a pair pivot relative to one another and a flexible element limits the open angle. Each leg is provided with a removable extension with a lateral pedal for forcing the end into the ground for enhanced stability. The legs rotate into a common plane and the extensions are removed to form a compact flat transport and storage package.

1 Claim, 2 Drawing Sheets

PORTABLE COLLAPSIBLE TODDLER SWING STAND

This invention relates to stands, and more particularly to a stand for supporting a toddler's swing that can be easily set up where a caregiver can observe a child while outdoors and that can be removed and closed up into a compact form for transport and storage.

BACKGROUND OF THE INVENTION

Vendors market many swings for use by small children. They are designed to be suspended from an overhead support such as a tree limb. Parents and other caregivers may wish to use the swing where there is no nearby overhead support of convenient elevation, such as when gardening or visiting a park that has swings only for older children and only tall trees.

A support of appropriate elevation that can be easily erected, removed, stored, and transported in a compact form would enhance use of these swings.

SUMMARY OF THE INVENTION

It is accordingly an object of the invention to provide a portable support or stand from which a swing may be suspended. It is another object that the support be readily reduced to a compact form for transport and storage. It is yet another object that the stand be erected and compacted without the use of tools. Because the stand must be useful to someone while carrying or caring for several children, it must be light in weight, and rapidly convertible between compact form and operational form. The stand or support of the invention comprises a horizontal support bar from which the swing is to be suspended. At each end of the bar are a pair of legs. One of the legs at earth end is pivotally attached to the bar so that the legs and bar may be folded into a common plane. Each leg may be extended for use. A flexible element joining the two legs at each end limits the extent to which the legs may be pivotally separated. A pedal at each leg may be pressed on to force the leg into the ground to firmly anchor the stand in place.

These and other objects, advantages and features of the invention will become more apparent when the detailed description is studied in conjunction with the drawings in which like elements in the various figures are designated by like reference characters.

DETAILED DESCRIPTION OF PREFERRED EMBODIMENTS

Figure 5:
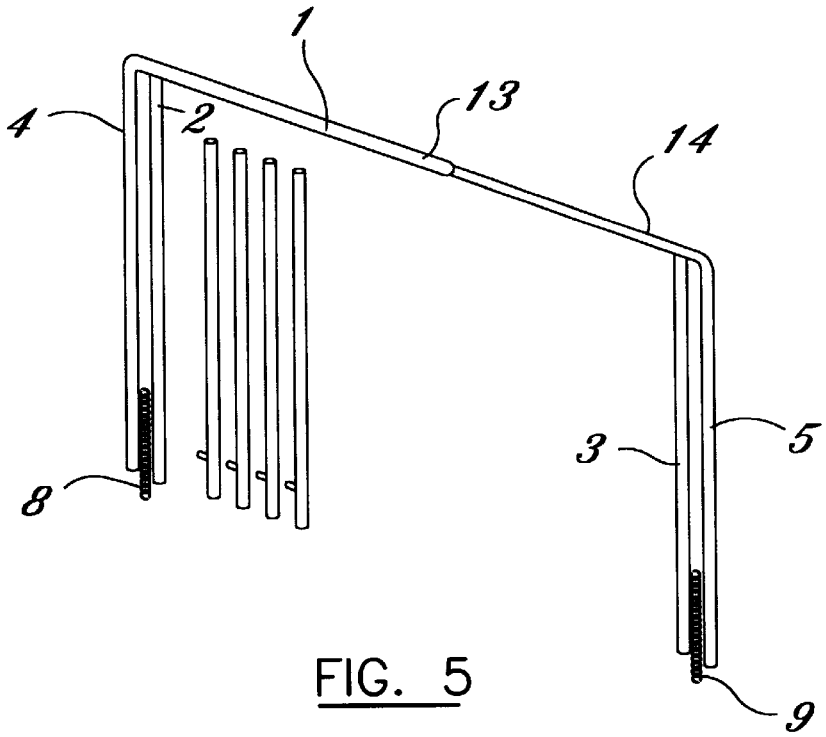
FIG. 5 is a perspective view of the stand in compact mode.

Referring now first to FIGS. 1–5, a folding collapsing portable support or stand for a toddler's swing to be suspended from an overhead horizontal support comprises a horizontal bar 1 having a first end 11 and a second end 12. Attached to the bar intermediate the ends are swing connecting elements 10 that may be in the form of loops or hooks. The horizontal bar 1 comprises a rigid outer pipe 13 and an inner rod 14 that is freely turnable within the pipe. Welded to pipe 13 are first leg 2 at first end 11 and second leg 3 at second end 12. Welded to the inner rod 14 are third leg 4 at end 11 and fourth leg 5 at end 12. The legs are all at right angles to bar 1, and the legs 4, 5 pivot relative to legs 2, 3 such that the legs all lie in a common plane with bar 1 for compact storage and transport, as seen in FIG. 5. Each leg is provided with a detachable extension 6 to further reduce the compact size. The extension 6 is removably attached at joint 15, as best seen in detail of FIG. 4. A threaded bolt 16 captive in the leg screws into a captive nut 17 in the extension. About six inches from the distal end of each extension a pedal is affixed. The pedal is stepped on to drive the leg end into the ground for enhanced stability of the stand in use. The extensions may be connected by other means well known in the art such as by telescoping (not shown).

Figure 1:
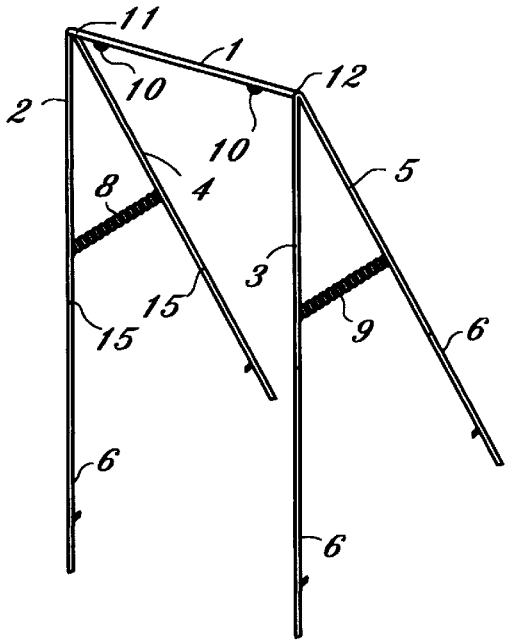
FIG. 1 is a perspective view of the stand in operational mode.
Figure 2:
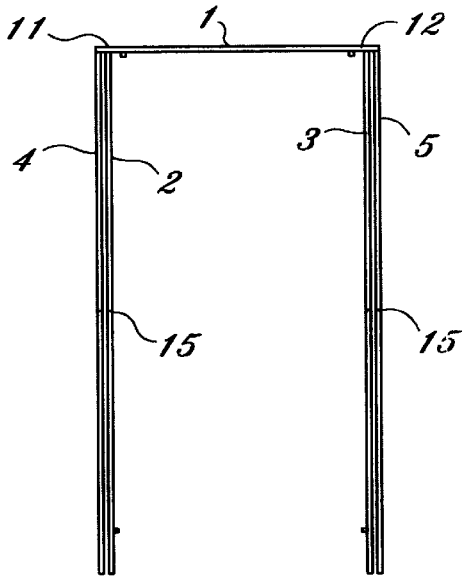
FIG. 2 is a front elevation view of the stand.
Figure 3:
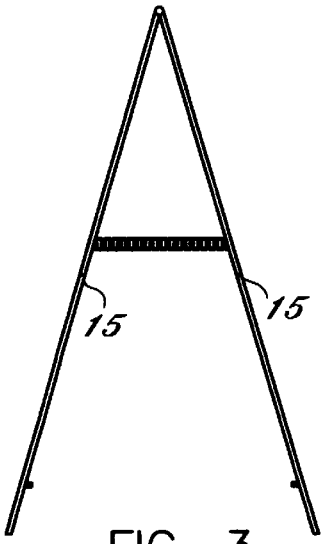
FIG. 3 is a side elevation view of the stand.
Figure 4:
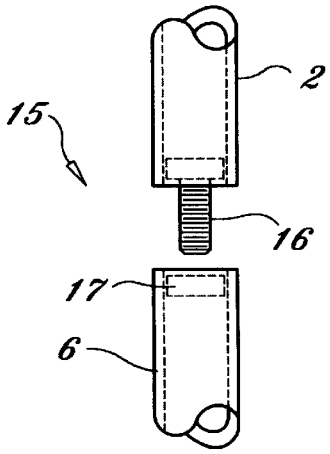
FIG. 4 is a detail of a leg joint indicated by the circle on FIG. 3.

The stand is reduced to the flat package shown in FIG. 5 for compact storage and transport. Then the extensions are removably attached to the legs and the legs rotated to operational position, the chains 8, 9 limit the angle of rotation so that triangles are formed at each end of the bar for enhanced stability. When the distal ends of the legs are driven into the ground by stepping on the pedals, a stable support for the swing is provided. As shown in FIG. 1, a stable open space free of obstructions to a swinging child is thus defined by the horizontal bar 1 at the top, triangularly disposed legs 3,5 extending from the bar to the ground at one side, triangularly dispose legs 2,4 extending from the bar to the ground at the other side, and the ground at the bottom of the space.

Figure 6:
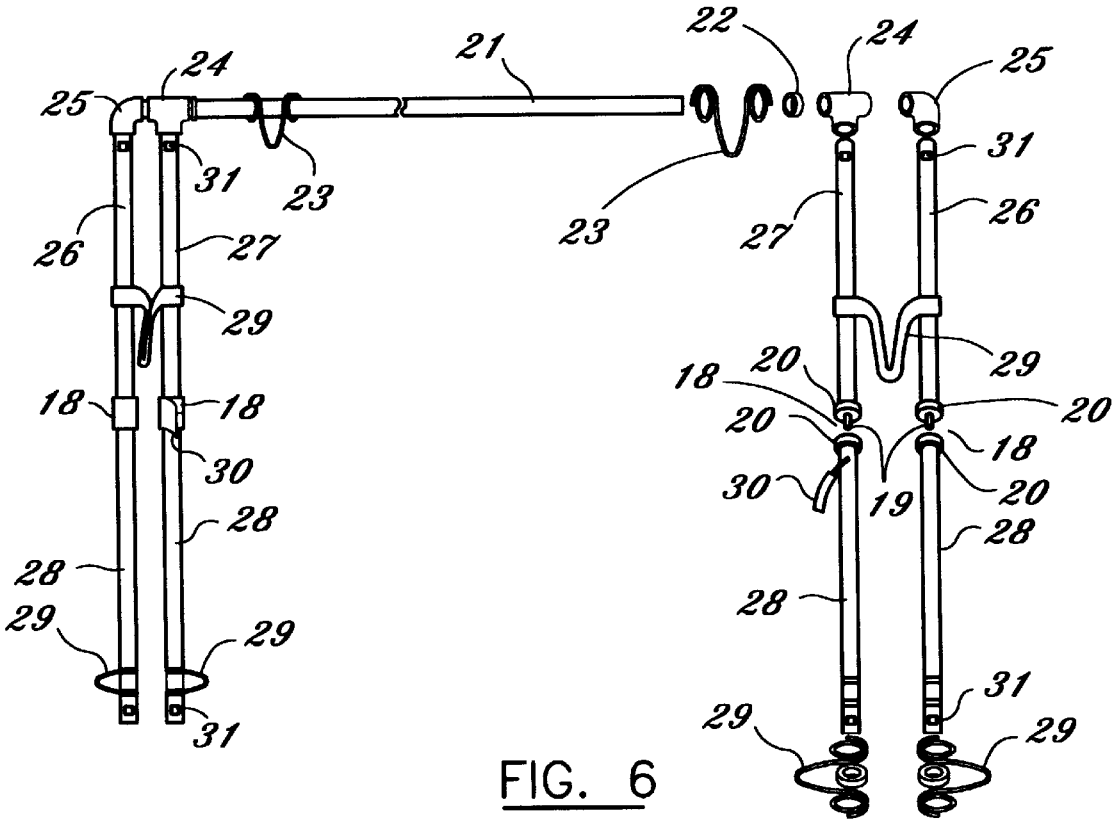
FIG. 6 is an exploded view of another embodiment of the stand of the invention.

Referring now to FIG. 6, another embodiment of the invention is shown that might be fabricated largely from PVC pipe and fittings, for example. Slid onto the horizontal pipe 21 are two bent wire loops 23 for swing connection. A collar 22 cut from pipe is slipped onto the pipe at each end and cemented in place. A T connector 24 is reamed out to freely rotate on pipe 21. One T connector is slipped over each end of pipe 21. Elbows 25 are cemented onto the ends of pipe 21. Legs 26 are cemented into the elbows. Legs 27 are cemented into the T connectors. Straps 29 fastened to the legs limit the angle to which the legs rotate. The leg extensions 28 are each provided with a bent wire pedal 29 which fits onto the extension and is held in place by cemented collar 30. The joint 18 for removably connecting the extension to the leg comprises an inner rod 19 cemented into the bore of the legs that fits snugly into the bore of the extension. Collars 20 of hook and loop material on the ends being joined are held in place by a strip 30 of complementary hook and loop material that is simply wrapped around the two collars to prevent their being pulled apart.

Hook and loop fasteners 31 cemented to the legs and extensions may be provided for holding the detached legs onto the folded assembly.

The above disclosed invention has a number of particular features which should preferably be employed in combination although each is useful separately without departure from the scopes of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A method of supporting a toddler's swing on a supporting ground comprising:

a) providing a folding toddler's swing stand comprising:

a horizontal support member having first and second ends;

first and second swing connecting elements attached to the horizontal support member intermediate the first and second ends, the swing connecting elements adapted for attaching to a toddler's swing, and for supporting thereon a swinging toddler;

a first leg connected to the first end;

a second leg connected to the first end;

means for rotating the second leg relative to the first leg between a compact mode in which the first and second legs are coplanar with the support member and an operational mode in which the legs are disposed at an angle to one another;

angle limiting means coupled between the first and second legs for limiting the angle therebetween;

a third leg connected to the second end;

a fourth leg connected to the second end;

means for rotating the fourth leg relative to the third leg between a compact mode in which the third and fourth legs are in a common plane with the support member and an operational mode in which the legs are disposed at an angle to one another;

angle limiting means coupled between the third and fourth legs for limiting the angle therebetween;

each of the legs provided with extension means for extending the length of the leg in the operational mode; and in which a stable open space free of obstruction to a swinging toddler, except for the swing and toddler, in said operational mode is defined by: the horizontal support member at the top of said space; the first and second legs triangularly disposed and extending from the horizontal support member to the supporting ground at a first side of said space; the third and fourth legs triangularly disposed and extending from the horizontal support member to the supporting ground at a second side of said space;

and the supporting ground at the bottom of said space;

b) deploying the stand in the operational mode; and c) attaching a swing to the swing connecting elements.

* * * * *